US007548043B2

(12) United States Patent
Chen

(10) Patent No.: US 7,548,043 B2
(45) Date of Patent: Jun. 16, 2009

(54) POWER SUPPLY APPARATUS AND METHOD FOR PROVIDING VOLTAGE

(75) Inventor: ShouFang Chen, Hsin-Chu Hsien (TW)

(73) Assignee: MStar Semiconductor, Inc., Hsin-Chu Hsien (TW)

( * ) Notice: Subject to any disclaimer, the term of this patent is extended or adjusted under 35 U.S.C. 154(b) by 352 days.

(21) Appl. No.: 11/560,365

(22) Filed: Nov. 16, 2006

(65) Prior Publication Data

US 2008/0001584 A1 Jan. 3, 2008

(30) Foreign Application Priority Data

Jun. 30, 2006 (TW) ..... 95123724 A

(51) Int. Cl.
*G05F 1/40* (2006.01)

(52) U.S. Cl. ..... 323/268

(58) Field of Classification Search ..... 323/266, 323/268, 271, 282, 283, 285; 363/73, 74

See application file for complete search history.

(56) References Cited

U.S. PATENT DOCUMENTS 5,420,778 A * 5/1995 Yoshino ..... 363/41
5,982,644 A * 11/1999 Hulsey et al. ..... 363/26
7,282,895 B2 * 10/2007 Thiele et al. ..... 323/266
7,450,407 B2 * 11/2008 Wu et al. ..... 363/89

* cited by examiner

*Primary Examiner*—Matthew V Nguyen
(74) *Attorney, Agent, or Firm*—Winston Hsu

(57) ABSTRACT

A power supply apparatus includes a current modulation unit, a voltage converting unit, a current detector, and a control unit. The current modulation unit is used for receiving an input voltage and a control signal, generating an output current and adjusting the value of the output current according to the control signal. The voltage converting unit, coupled to the current modulation unit, converts the output current into the output voltage. The current detector, coupled to the voltage converting unit and the output terminal, detects the current flowing through the load and outputs a current detection result. The control unit, coupled to the current modulation unit, the current detector and the output terminal, receives the current detection result and the output voltage, and generates the control signal according to the current detection result and the output voltage.

20 Claims, 3 Drawing Sheets

POWER SUPPLY APPARATUS AND METHOD FOR PROVIDING VOLTAGE

CROSS REFERENCE TO RELATED APPLICATIONS

This application claims the benefit of Taiwan application Serial No. 95123724, filed Jun. 30, 2006, the subject matter of which is incorporated herein by reference.

BACKGROUND OF THE INVENTION

1. Field of the Invention

The present invention relates to a power supply apparatus and a method for providing a voltage, and more particularly relates to a power supply apparatus, which can automatically adjust the output voltage, and the method thereof.

2. Description of the Prior Art

A power supply usually provides only a fixed output voltage. When a couple of different voltages are required, a user should prepare either several different power supplies, each of which provides a specific fixed output voltage, or a power supply that provides a limited number of different output voltages selectable by user switching. However, this kind of power supply should be switched manually to a desired voltage corresponding to different output objectives, and therefore it is inconvenient to use such power supplies. In addition, a stock of too many power supplies is uneconomic and hard to manage.

SUMMARY OF THE INVENTION

It is therefore an object of the present invention to provide a power supply apparatus and method for automatically adjusting the output voltage.

The present invention discloses a power supply apparatus having an output terminal coupled to a load, wherein the power supply apparatus outputs an output voltage through the output terminal. The power supply apparatus includes a current modulation unit, a voltage converting unit, a current detector and a control unit. The current modulation unit is used for receiving an input voltage and a control signal, and generating an output current. The current modulation unit adjusts the amount of the output current according to the control signal. The voltage converting unit, which is coupled to the current modulation unit, converts the output current into the output voltage. The current detector, which is coupled between the voltage converting unit and the output terminal, detects the current flowing through the load and outputs a current detection result. The control unit, which is coupled to the current modulation unit, the current detector and the output terminal, receives the current detection result and the output voltage, and generates the control signal according to the current detection result and the output voltage.

The present invention also discloses a method for providing an output voltage to a load. The method includes: providing a current; converting the current into the output voltage; detecting the current flowing through the load and generating a current detection result; and generating a control signal according to the current detection result and the output voltage, and controlling the amount of the current according to the control signal.

The present invention discloses a power supply apparatus having an output terminal coupled to a load, wherein the power supply apparatus outputs an output voltage through the output terminal. The power supply apparatus includes a current modulation unit, a voltage converting unit, a current detector, a determination circuit, a digital control unit, and a digital to analog converter. The current modulation unit receives an input voltage and a control signal, generates an output current, and adjusts the amount of the output current according to the control signal. The voltage converting unit, which is coupled to the current modulation unit, converts the output current into the output voltage. The current detector, which is coupled between the voltage converting unit and the output terminal, detects the current flowing through the load and outputting a current detection result. The determination circuit, which is coupled to the current detector and the output terminal, determines the output voltage and the current detection result and outputs a starting signal and a holding signal. The digital control unit, which is coupled to the determination circuit, generates a digital signal according to the starting signal and the holding signal. The digital to analog converter, which is coupled to the digital control unit and the current modulation unit, converts the digital signal into the control signal.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
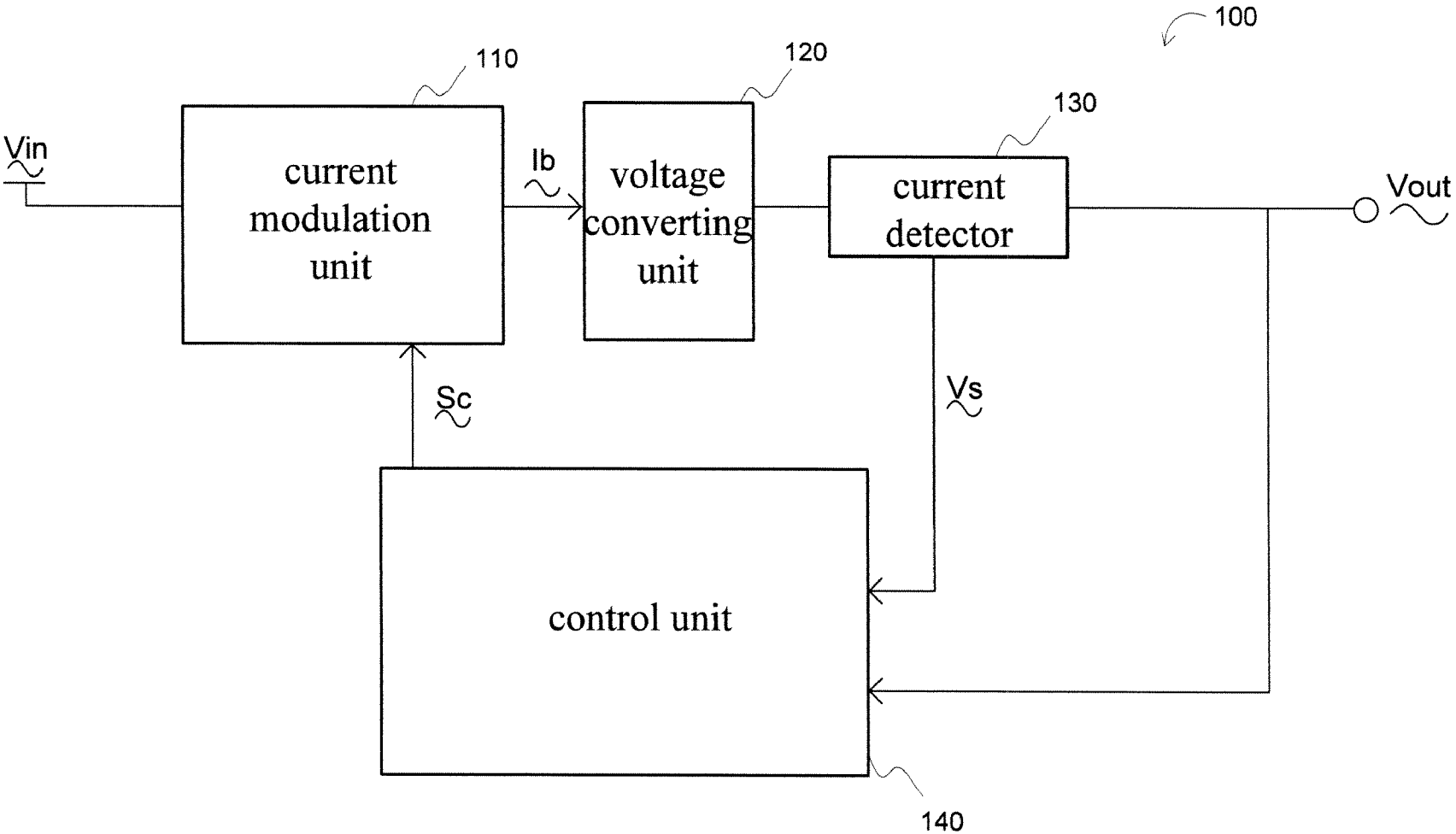
FIG. 1 illustrates a power supply apparatus according to a first embodiment of the present invention.

Please refer to FIG. 1. FIG. 1 illustrates a power supply apparatus according to a first embodiment of the present invention. The power supply apparatus 100 includes a current modulation unit 110, a voltage converting unit 120, a current detector 130 and a control unit 140. The current modulation unit 110 receives the input voltage $V_{in}$ and the control signal $S_c$ from the control unit 140, and the current modulation unit 110 is controlled by the control signal $S_c$ to adjust the amount of the current $I_b$. In this embodiment, the control unit 140 generates a digital signal according to a clock signal, and the value of the digital signal increases gradually according to the frequency of the clock signal. The higher the frequency of the clock signal, the faster the value of the digital signal increases. The digital signal is converted into an analog current signal by a digital to analog converter (ADC). The analog current signal is the control signal $S_c$ which controls the current modulation unit 110 to adjust the amount of the current $I_b$. The current modulation unit 110 increases the amount of the current $I_b$ in accordance with the increase of the value of the digital signal. The voltage converting unit 120, which is coupled to the current modulation unit 110, is used for converting the output current $I_b$ into an output voltage $V_{out}$. In this embodiment, the voltage converting unit 120 is composed of at least one operational amplifier and at least one transistor. The output voltage $V_{out}$ is transmitted to the output terminal of the power supply apparatus 100 via the current detector 130. The output terminal can be coupled to a load (not illustrated) to provide the desired voltage for the load, and the control unit 140 receives the output voltage $V_{out}$ as well as monitors the value of the output voltage $V_{out}$. The current detector 130 detects the value of the current, which the power supply apparatus 100 provides to the load, and generates a current detection result $V_s$, which is a voltage signal, corresponding to the load current. As described above, since the output current $I_b$ of the current modulation unit 110 keeps increasing, the output voltage $V_{out}$ converted by the voltage converting unit 120 keeps increasing as well. In addition, when the load receives an increasing voltage, the load current increases accordingly, which results in an increase in the detection result $V_s$. The load current tends to be stable and does not increase when the load receives enough voltage and operates in a stable state. The control unit 140 determines when to stop increasing the value of the digital signal according to the detection result $V_s$ and the output voltage $V_{out}$. More specifically, when the control unit 140 determines that the detection result $V_s$ becomes stable and the output voltage $V_{out}$ keeps increasing, the control unit 140 locks the value of the digital signal such that the current modulation unit 110 stops increasing the output current $I_b$, and thereby the voltage value of output voltage $V_{out}$ is fixed.

The current detector 130 has another function. The power supply apparatus 100 initially outputs a small voltage before any load is connected. Meanwhile, the current detector 130 detects the variation of the load current, and the control unit 140 compares the detection result $V_s$ with a threshold value. When a load is connected to the power supply apparatus 100, there will be a change in the detection result $V_s$. Therefore, when the detection result $V_s$ becomes larger than the threshold value, the control unit 140 resets the value of the digital signal and regenerates the digital signal. In brief, the power supply apparatus 100 staffs to gradually increase the output voltage $V_{out}$ provided to the load after the load is connected to the power supply apparatus 100. The increasing rate of the output voltage $V_{out}$ can be determined according to the frequency of the clock signal of the control unit 140. The current detector 130 detects the load current flowing through the load when the output voltage $V_{out}$ increases. The power supply apparatus 100 stops increasing the output voltage $V_{out}$ and utilizes the present output voltage $V_{out}$ as the output voltage when the load current stops increasing. Thereby the load can operate in a stable state. Please refer to FIG. 2, which shows the relation between the load current and the output voltage $V_{out}$. $V_{set}$ is the stable output value of the power supply apparatus 100.

Figure 2:
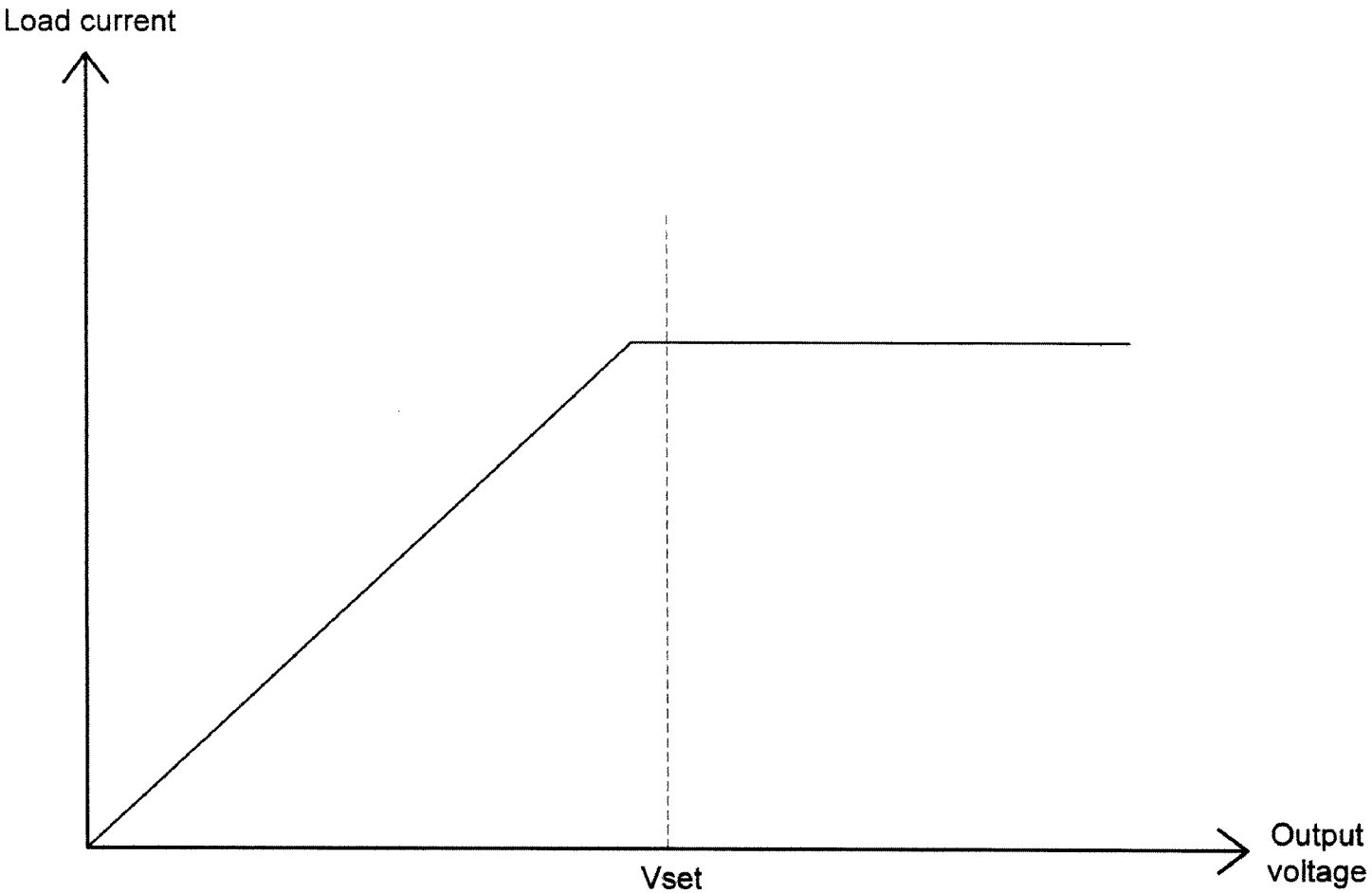
FIG. 2 illustrates the relation between the load current and the output voltage.
Figure 3:
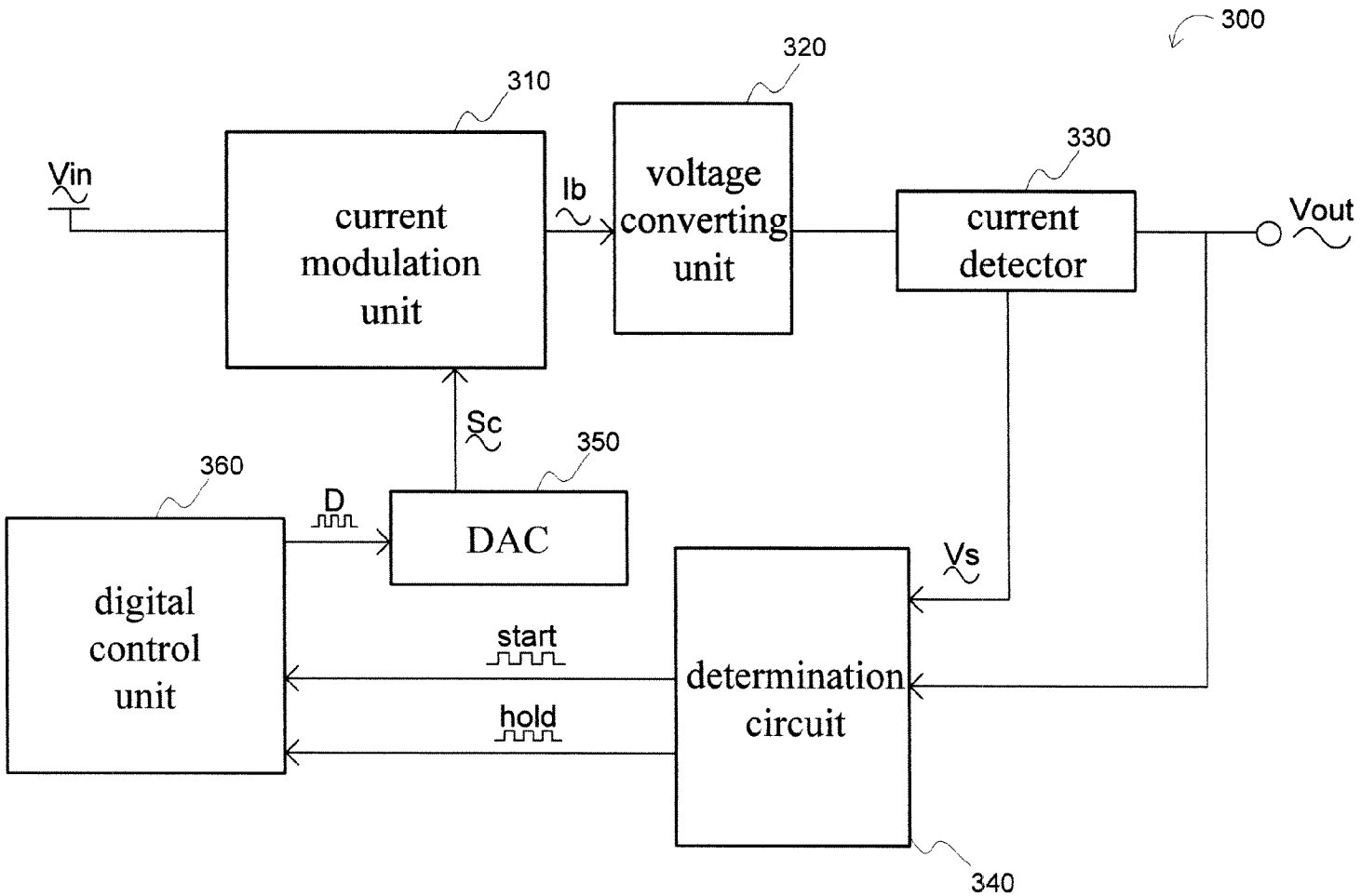
FIG. 3 illustrates a power supply apparatus according to a second embodiment of the present invention.

Please refer to FIG. 3. FIG. 3 illustrates a power supply apparatus according to a second embodiment of the present invention. The power supply apparatus 300 includes a current modulation unit 310, a voltage converting unit 320, a current detector 330, a determination circuit 340, a digital to analog converter (DAC) 350 and a digital control unit 360. The digital control unit 360 generates a multi-bit digital signal D (for example, 8-bit) according to a clock signal, and gradually increases the value of the digital signal D corresponding to the frequency of the clock signal. The digital to analog converter 350 converts the digital signal D into a control signal $S_c$, which can be an analog current signal. The current modulation unit 310 receives an input voltage $V_{in}$ and is controlled by the control signal $S_c$ to adjust the amount of the output current $I_b$. The larger the value of the digital signal D, the larger the output current $I_b$ is. Next, the voltage converting unit 320 converts the output current $I_b$ into the output voltage $V_{out}$, and the output voltage $V_{out}$ is transmitted to the output terminal of the power supply apparatus 300 through the current detector 330. The output terminal can be coupled to a load (not illustrated), which is provided with the output voltage, and the output voltage $V_{out}$ is transmitted to the determination circuit 340 as well. The current detector 330 is used for detecting the current flowing through the load and converting the load current into a current detection result $V_s$, which is a voltage signal and transmitted to the determination circuit 340. As described above, since the output current $I_b$ increases in response to the increase of the value of the digital signal D, the output voltage $V_{out}$ also increases in response to the increase of the value of the digital signal D. The load current increases when the load receives an increasing voltage, and the load current would stop increasing when the load operates in a stable state, in which the detection result $V_s$ tends to be constant. The relation between the load current and the output voltage $V_{out}$ is shown in FIG. 2. The determination circuit 340 determines the output voltage $V_{out}$ and the detection result $V_s$. The determination circuit 340 generates a digital holding signal "hold" to inform the digital unit 360 to stop increasing the value of the digital signal D when the determination circuit 340 determines that the detection result $V_s$ stop increasing and the voltage $V_{out}$ keeps increasing. As a result, the value of the output voltage $V_{out}$ can be fixed, which is the $V_{set}$ shown in FIG. 2. In addition, the power supply apparatus 300 initially outputs a small voltage before any load is connected. Meanwhile, the current detector 330 detects the variation of the load current and the determination circuit 340 compares the detection result $V_s$ with a threshold value. When a load is connected to the power supply apparatus 100, there will be a change in the detection result $V_s$. Therefore, when the detection result $V_s$ becomes larger than the threshold value, the determination circuit 340 generates a digital starting signal "start" to indicate the digital control unit 360 to reset and then regenerate the digital signal D. In brief, the power supply apparatus 300 gradually and automatically increases the output voltage $V_{out}$ provided to the load after the load is connected to the power supply apparatus 300. The current detector 330 detects the load current flowing through the load when the output voltage $V_{out}$ is increasing. The power supply apparatus 300 stops increasing the output voltage $V_{out}$ and utilizes the output voltage $V_{out}$ at that time as the output value when the load current stops increasing. As a result, the load can operate in a stable state.

The present invention provides a power supply apparatus and a method for automatically providing a suitable voltage to a load. The apparatus and method can automatically generate a suitable voltage corresponding to the load, and thereby only a single power supply apparatus is required for various kinds of loadings. There will be no need to manually switch the value of the output voltage; therefore, the problems in the prior art can be solved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power supply apparatus having an output terminal coupled to a load, wherein the power supply apparatus outputs an output voltage through the output terminal, the power supply apparatus comprising:

a current modulation unit, for receiving an input voltage and a control signal and generating an output current, wherein the current modulation unit adjusts the amount of the output current according to the control signal;

a voltage converting unit, coupled to the current modulation unit, for converting the output current into the output voltage;

a current detector, coupled between the voltage converting unit and the output terminal, for detecting the current flowing through the load and outputting a current detection result; and a control unit, coupled to the current modulation unit, the current detector and the output terminal, for receiving the current detection result and the output voltage, and generating the control signal according to the current detection result and the output voltage.

2. The power supply apparatus of claim 1, wherein the current modulation unit is controlled by the control signal to continuously increase the output current, and when the current detection result indicates that the current flowing through the load stops increasing and the output voltage keeps increasing, the control unit controls the current modulation unit to stop increasing the output current and the output voltage of the voltage converting unit at that time is utilized as the output voltage of the power supply apparatus.

3. The power supply apparatus of claim 1, wherein the control unit comprises:

a digital control unit, for generating a digital signal;

a digital to analog converter, coupled to the digital control unit and the current modulation unit, for converting the digital signal into the control signal; and a determination circuit, coupled to the current detector, the output terminal and the digital control unit, for receiving the output voltage and the current detection result and outputting a starting signal and a holding signal to the digital control unit.

4. The power supply apparatus of claim 3, wherein the digital control unit refers to a clock signal to increase the value of the digital signal.

5. The power supply apparatus of claim 3, wherein the digital to analog converter converts the digital signal into an analog current control signal to control the current modulation unit.

6. The power supply apparatus of claim 3, wherein the determination circuit compares the current detection result with a threshold value and if the current detection result is larger than the threshold value, the determination circuit outputs the starting signal to the digital control unit to control the digital control unit to reset and regenerate the digital signal.

7. The power supply apparatus of claim 3, wherein when the determination circuit determines that the detection result reaches a stable state and the output voltage keeps increasing, the determination circuit outputs the holding signal to the digital control unit to control the digital control unit to stop increasing the value of the digital signal.

8. A method for providing an output voltage to a load, comprising:

providing a current;

converting the current into the output voltage;

detecting the current flowing through the load and generating a current detection result; and generating a control signal according to the current detection result and the output voltage, and controlling the amount of the current according to the control signal.

9. The method of claim 8, wherein the amount of the current is increased by the control of the control signal, and when the current detection result indicates that the current flowing through the load stops increasing and the output voltage keeps increasing, the control signal controls the output current to stop increasing and the output voltage at that time is provided to the load.

10. The method of claim 8 further comprising:

generating a digital signal;

converting the digital signal to the control signal; and adjusting the digital signal according to the output voltage and the current detection result.

11. The method of claim 10, wherein the step of generating the digital signal is performed by referring to a clock signal to increase the value of the digital signal.

12. The method of claim 10, wherein the control signal is an analog current signal.

13. The method of claim 10, wherein the step of adjusting the digital signal is performed by comparing the current detection result with a threshold value, and when the current detection result is larger than the threshold value, the digital signal is reset and regenerated.

14. The method of claim 10, wherein in the step of adjusting the digital signal, if the detection result reaches a stable state and the output voltage keeps increasing, the value of the digital signal stops increasing.

15. A power supply apparatus having an output terminal coupled to a load, wherein the power supply apparatus outputs an output voltage through the output terminal, the power supply apparatus comprising:

a current modulation unit, for receiving an input voltage and a control signal and generating an output current, wherein the current modulation unit adjusts the amount of the output current according to the control signal;

a voltage converting unit, coupled to the current modulation unit, for converting the output current into the output voltage;

a current detector, coupled between the voltage converting unit and the output terminal, for detecting the current flowing through the load and outputting a current detection result;

a determination circuit, coupled to the current detector and the output terminal, for determining the output voltage and the current detection result, and outputting a starting signal and a holding signal;

a digital control unit, coupled to the determination circuit, for generating a digital signal according to the starting signal and the holding signal; and a digital to analog converter, coupled to the digital control unit and the current modulation unit, for converting the digital signal into the control signal.

16. The power supply apparatus of claim 15, wherein the current modulation unit is controlled by the control signal to continuously increase the output current, and the control signal controls the current modulation unit to stop increasing the output current when the current detection result indicates that the current flowing through the load stops increasing and the output voltage keeps increasing, and the output voltage of the voltage converting unit at that time is utilized as the output voltage of the power supply apparatus.

17. The power supply apparatus of claim 15, wherein the digital control unit refers to a clock signal to increase the value of the digital signal.

18. The power supply apparatus of claim 15, wherein the digital to analog converter converts the digital signal into an analog current control signal to control the current modulation unit.

19. The power supply apparatus of claim 15, wherein the determination circuit compares the current detection result with a threshold value and the determination circuit outputs the starting signal to the digital control unit to control the digital control unit to reset and regenerate the digital signal if the current detection result is larger than the threshold value.

20. The power supply apparatus of claim 15, wherein the determination circuit outputs the holding signal to the digital control unit to control the control unit to stop increasing the value of the digital signal if the determination circuit determines that the detection result reaches a stable state and the output voltage keeps increasing.

* * * * *